US007789235B2

(12) United States Patent
Trapp et al.

(10) Patent No.: US 7,789,235 B2
(45) Date of Patent: Sep. 7, 2010

(54) RELEASABLE PRODUCT FASTENER FOR PRODUCT PACKAGING

(75) Inventors: Timothy J. Trapp, Orchard Park, NY (US); Charles Smith, East Amherst, NY (US)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 12/245,852

(22) Filed: Oct. 6, 2008

(65) Prior Publication Data

US 2010/0084301 A1 Apr. 8, 2010

(51) Int. Cl.
*B65D 73/00* (2006.01)

(52) U.S. Cl. ..... 206/477; 206/495

(58) Field of Classification Search ..... 206/477, 206/478, 480, 483, 495, 775, 736
See application file for complete search history.

(56) References Cited

U.S. PATENT DOCUMENTS 3,811,565 A * 5/1974 Tancredi ..... 206/478
3,963,123 A 6/1976 Beal
4,185,739 A * 1/1980 Wilford ..... 206/477
4,865,097 A * 9/1989 Allen ..... 150/154
5,018,253 A * 5/1991 Oppenheimer ..... 24/458
5,289,916 A * 3/1994 Mickelberg ..... 206/756
5,501,330 A * 3/1996 Betts ..... 206/349
6,425,482 B1 * 7/2002 Chiang ..... 206/349

FOREIGN PATENT DOCUMENTS

JP 0596670 A2 5/1994
JP 07-300157 A 11/1995
JP 2004-065659 A 3/2004

OTHER PUBLICATIONS

PCT Search Report and Written Opinion for PCT/US2009/059163, May 28, 2010, 6 pages.

* cited by examiner

*Primary Examiner*—Jacob K Ackun, Jr.
(74) *Attorney, Agent, or Firm*—Edell, Shapiro & Finnan, LLC

(57) ABSTRACT

The present invention is directed toward a product fastening system and, in particular, to a mechanism for securing a toy within product packaging. The packaging may include a toy support platform having a through-hole extending from a first surface to a second surface; a pliable strip configured to pass through the through-hole formed in the toy support platform and a fastener clip that captures the pliable strip to secure the toy to the support platform. The fastener clip may include a base with a plurality of notches formed therein. In operation, the pliable strip is wrapped around the toy object. The ends of the pliable strip are inserted through the through hole and inserted into the notch, becoming secured therein without the need for braiding or twisting the ends of the pliable strip.

21 Claims, 12 Drawing Sheets

RELEASABLE PRODUCT FASTENER FOR PRODUCT PACKAGING

FIELD OF THE INVENTION

The present invention is directed toward a releasable fastener and, in particular, to toy product/display packaging including a releasable, reusable fastener.

BACKGROUND OF THE INVENTION

Toys are generally placed in packaging which will provide some protection to the toy and provide a means to easily display the toy. The toys are often held in the packaging by wire ties (also know as "twist ties") that surround the toy and extend into the packaging, with the ends of the wire tie being braided to hold the toy in place. While this may work well for small toys, large toys require a significant number of wire ties and a significant amount of wire tie material. Thus, safely securing toys within packaging generates a large amount of waste. Furthermore, because of the shape of a toy, it may not be practical to place the wire tie around the toy. The wire tie must therefore be threaded through a portion of the toy or the toy must remain loose in the packaging. Removing a wire-tied toy from the packaging, moreover, is a difficult process for a consumer. Thus, it would be desirable to provide a mechanism to safely secure toys of various shapes and sizes within product packaging, while minimizing the amount of wire utilized and making removal of the toy from the wire ties and the packaging easier for the consumer.

SUMMARY OF THE INVENTION

The present invention is directed toward a product fastening system and, in particular, to a mechanism for securing a toy within display packaging. The packaging may include a pliable member or strip, a toy support platform having a channel that receives the pliable strip, and a fastener clip that engages the strip to secure the strip to the support platform. The fastener clip may include a base having a one or more notches configured to releasably capture the pliable strip. In operation, the pliable strip is wrapped around a product such as a toy. The ends of the strip are then inserted into through-holes in the toy platform and positioned within respective notches, becoming secured therein without requiring the braiding or twisting of the ends. To remove the product from the support platform, the fastener clip is urged away from the ends of the strip, drawing the strip's ends out of the notches.

DETAILED DESCRIPTION OF THE INVENTION

Figure 1A:
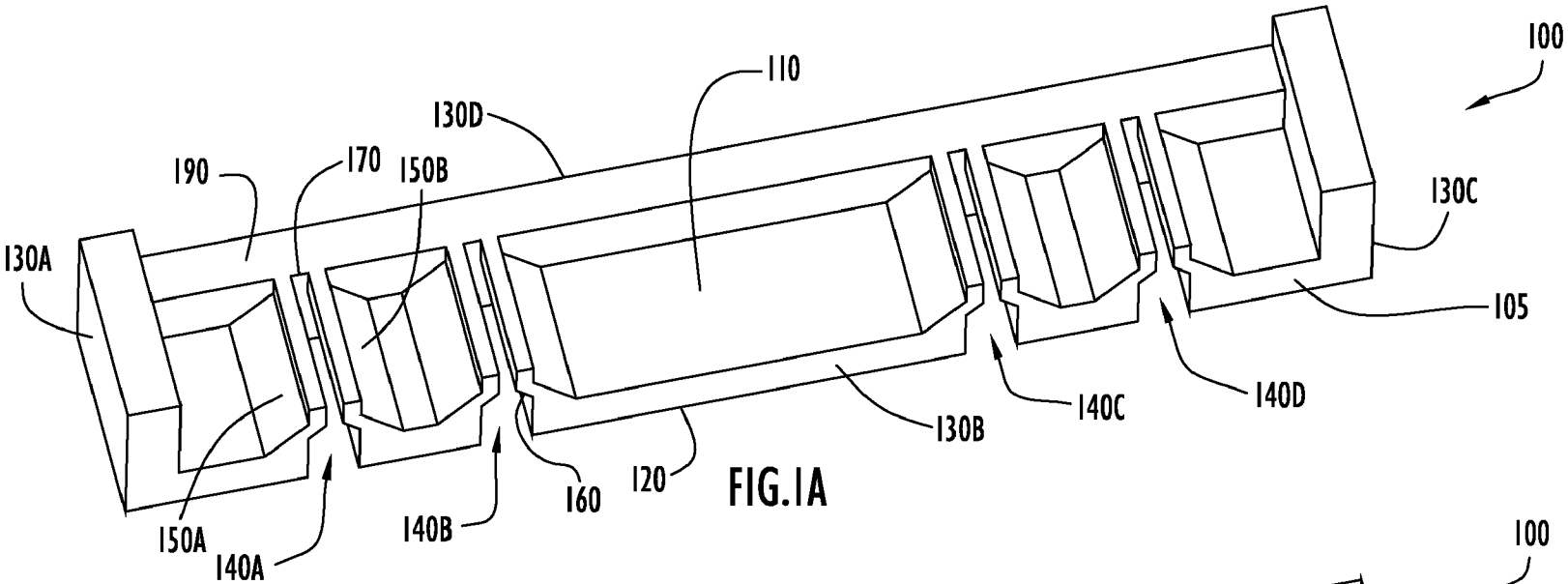
FIG. 1A illustrates a front perspective view of a fastener clip according to an embodiment of the invention.
Figure 1B:
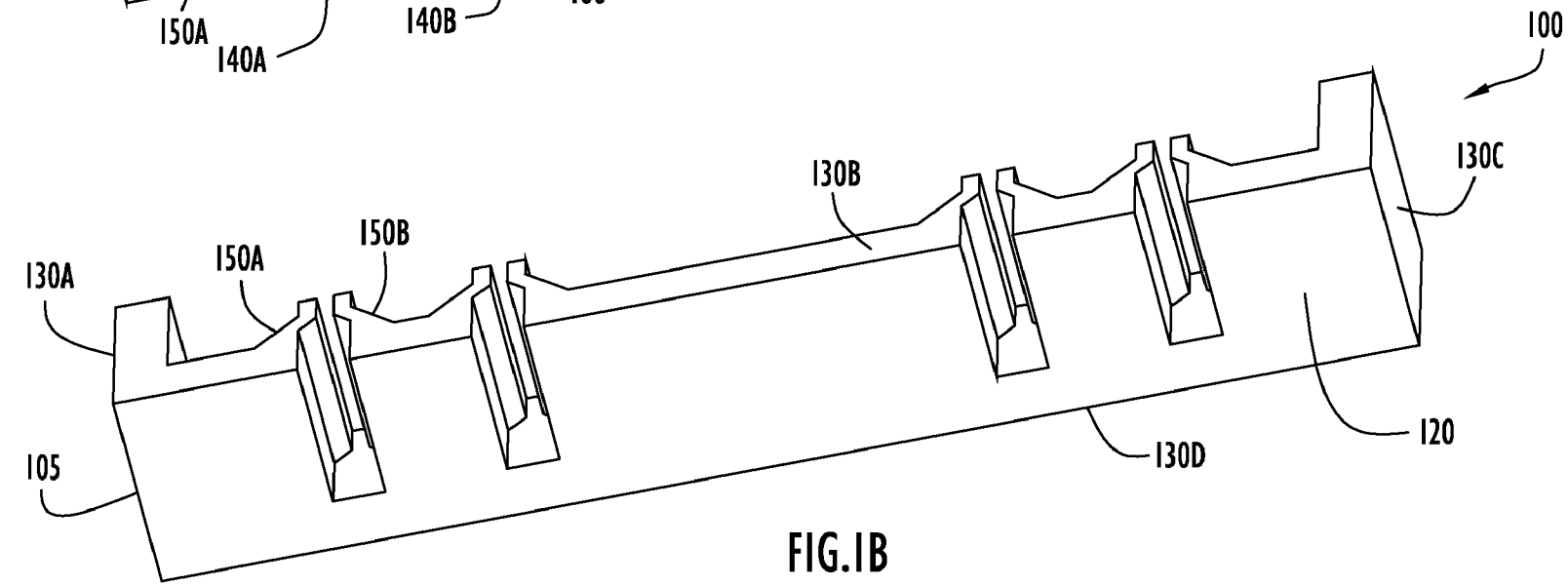
FIG. 1B illustrates a rear perspective view of the fastener clip shown in FIG. 1A.

The fastening system of the present invention includes a fastening clip and a securing member. FIGS. 1A and 1B show a fastening clip 100 in accordance with an embodiment of the invention. The fastening clip 100 includes a base 105 having a front or first side 110 and a rear or second side 120. The base 105 may possess any shape and have any suitable dimensions. In the illustrated embodiment, the base 105 possesses a generally elongate shape having a first side edge 130A, a top edge 130B, a second side edge 130C, and a bottom edge 130D.

Figure 1C:
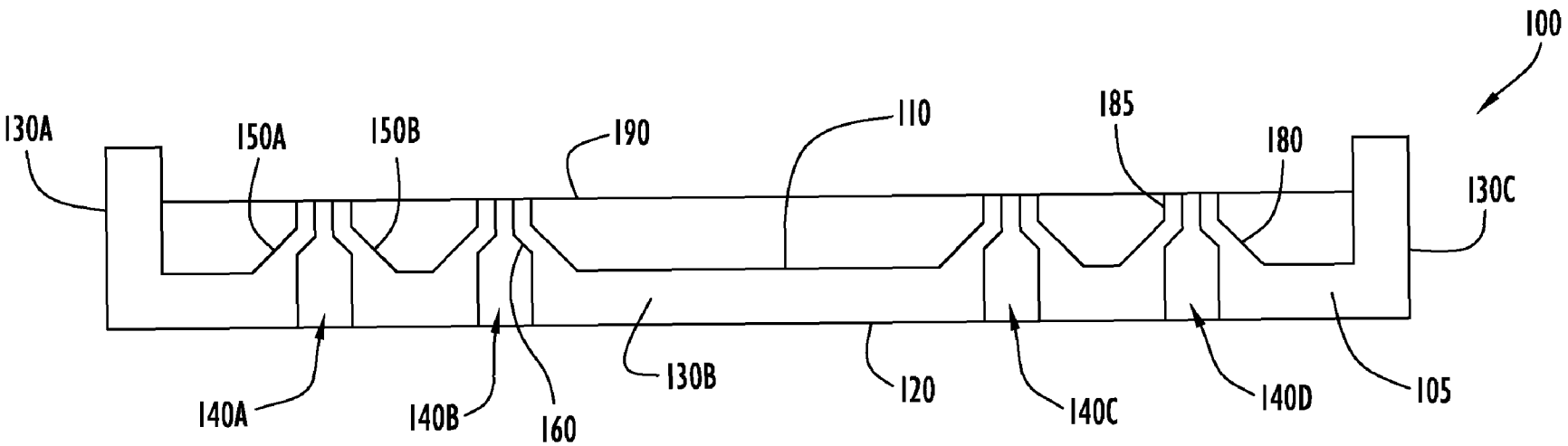
FIG. 1C illustrates a top view of the fastener clip shown in FIG. 1A

The base 105 further includes one or more notches (140A, 140B, 140C, and 140D) operable to capture the pliable member (discussed in greater detail below). Each notch 140A-D, extending inboard from the perimeter of the base 105, is defined by a first wall or ramp 150A and a second wall or ramp 150B, each extending outward from the front surface 110 of the base 105. The notch 140A-D includes a first or upper end 160 (also called a notch gate) and a second or lower end 170 (also called a notch base). The walls 150A, 150B may converge upon each other such that the outer edges of the walls are generally parallel. In the embodiment illustrated in FIG. 1C, each wall 150A, 150B includes a converging portion 180, in which the first wall 150A and the second wall 150B angle outward, and a generally parallel portion 185, in which the first wall 150A is spaced from the second wall 150B. The distance between the walls 150A, 150B is not particularly limited, but is preferably to permit the insertion and frictional engagement of the securing member between the walls.

Figure 6A:
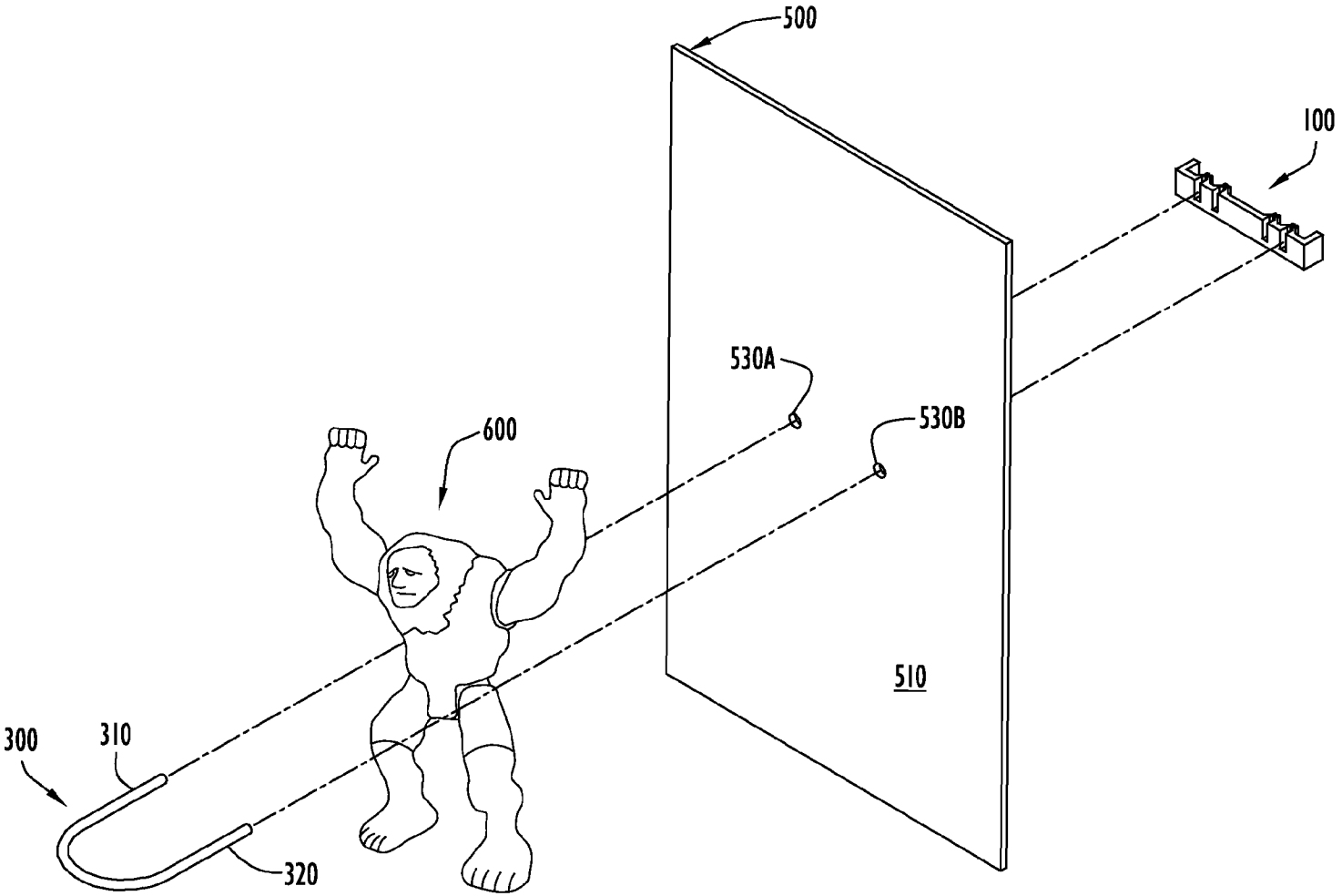
FIG. 6A illustrates an exploded view of a toy product being secured to the support platform utilizing the pliable member and clip in accordance with an embodiment of the invention.

The securing member 300 engages the product and becomes releasably captured to the fastening clip 100. The securing member 300 may be formed of any suitable material and possesses dimensions suitable for its described purpose. By way of example, the securing member 300 may be a pliable member adapted to wrap around the product or a portion of the product. By way of specific example, the securing member 300 may be a wire tie or twist tie, a string, a strap, etc. The securing member 300 includes a first end 310 and a second end 320 (seen in FIG. 6A) configured to pass through openings formed into a product support platform (discussed in greater detail below).

Figure 3:
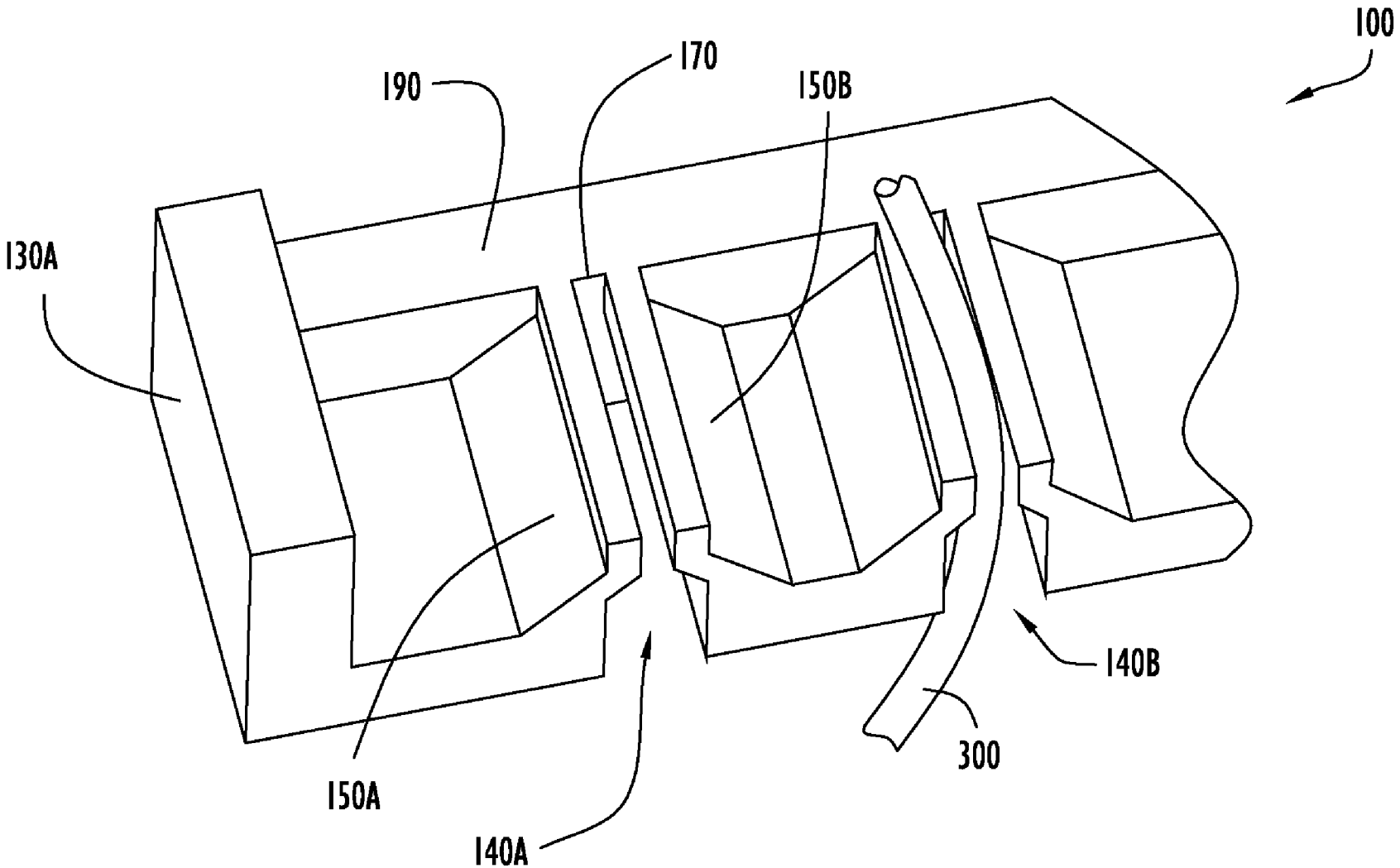
FIG. 3 illustrates a close-up view of a notch with a pliable member positioned therein.

The securing member 300, moreover, may frictionally engage the notches 140A-D of the clip 100. In operation, as shown in FIG. 3, the securing member 300 may be received into the notch 140A-140D, becoming positioned between the walls 150A, 150B. The walls 150A, 150B (i.e., within the parallel portion 185) frictionally engage the ends 310, 320 of the securing member 300, capturing the securing member therein. This in turn, secures a product to a product support platform without the need to tie, twist, or braid the ends 310, 320 of the securing member 300 together (discussed in greater detail below).

Figure 4:
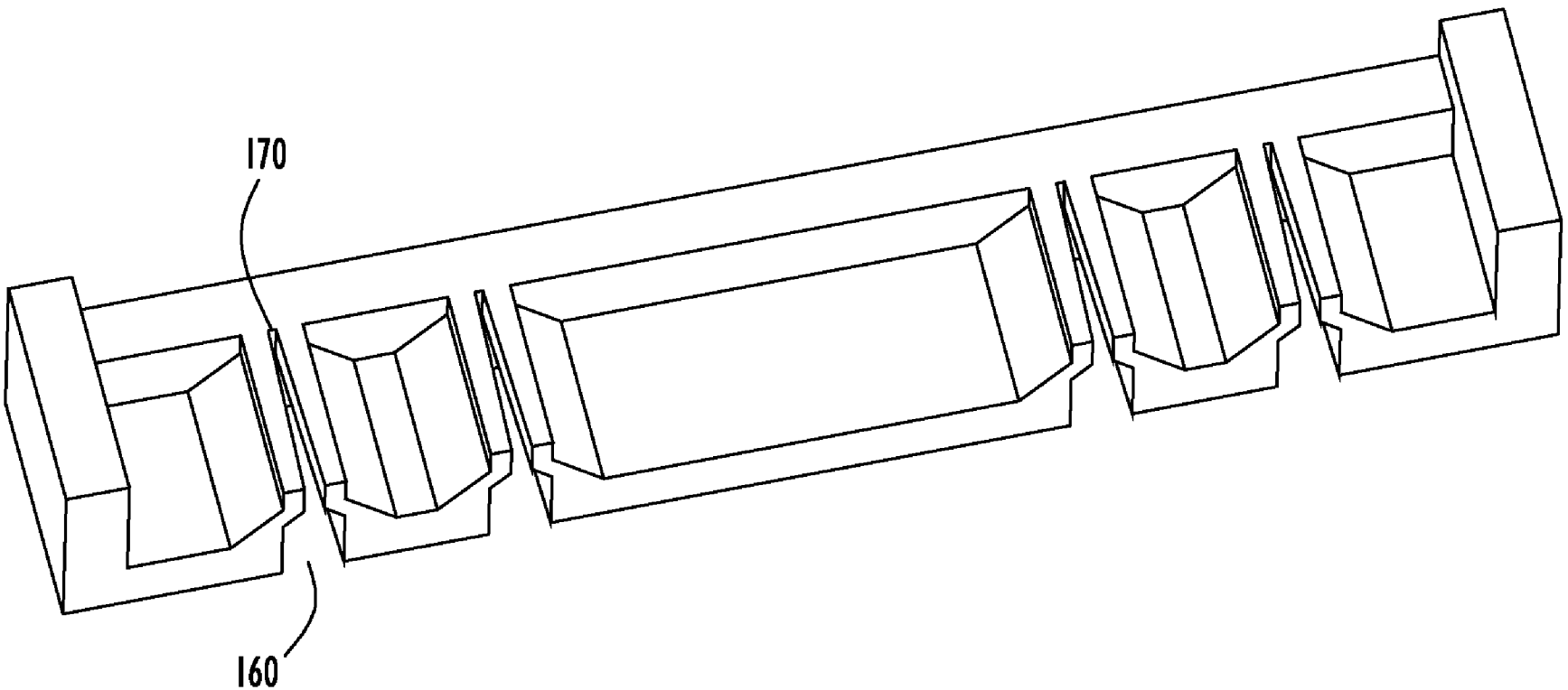
FIG. 4 illustrates a front perspective view of a fastener clip in accordance with another embodiment of the invention, showing a V-shaped notch.

Another embodiment for a notch configuration is illustrated in FIG. 4. As shown, the walls 150A, 150B of the notch 140 may taper from the upper end 160 to the lower end 170 to form a V-shaped notch. With this configuration, as the securing member 300 is inserted into the V-shaped notch, the notch applies increasing pressure to the securing member 300 as it travels from the open end 160 to the closed end 170, capturing the securing member 300 within the notch 140.

Figure 2A:
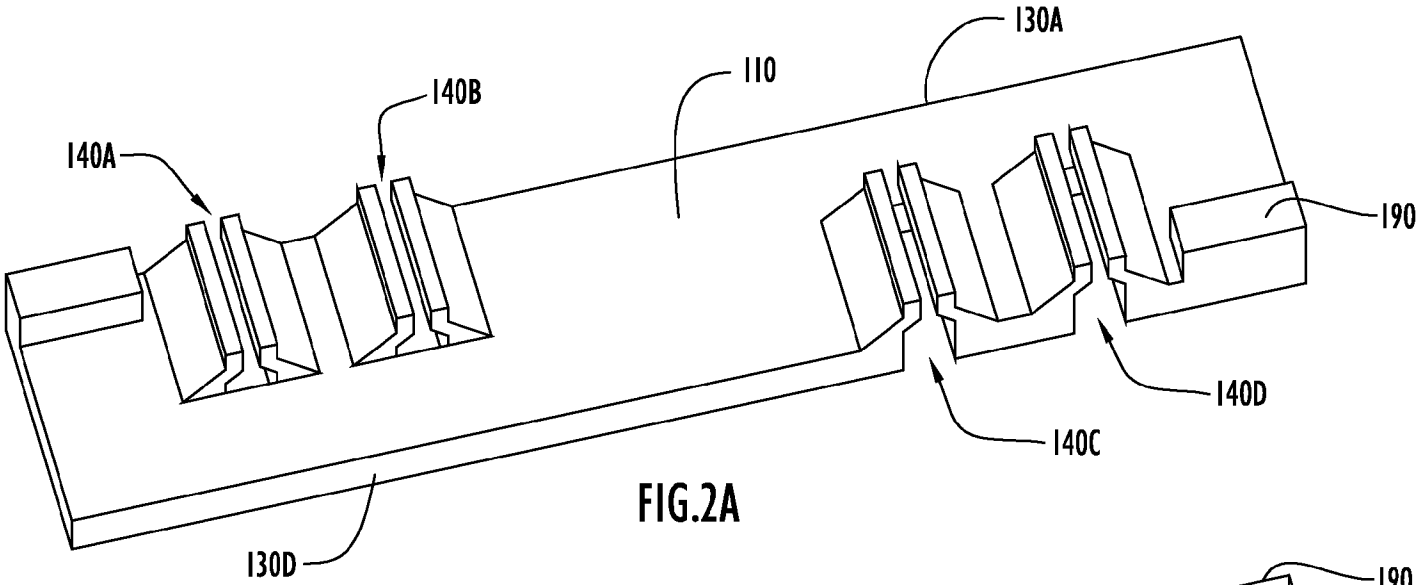
FIG. 2A illustrates a front perspective view of a fastener clip according to another embodiment of the invention.
Figure 2B:
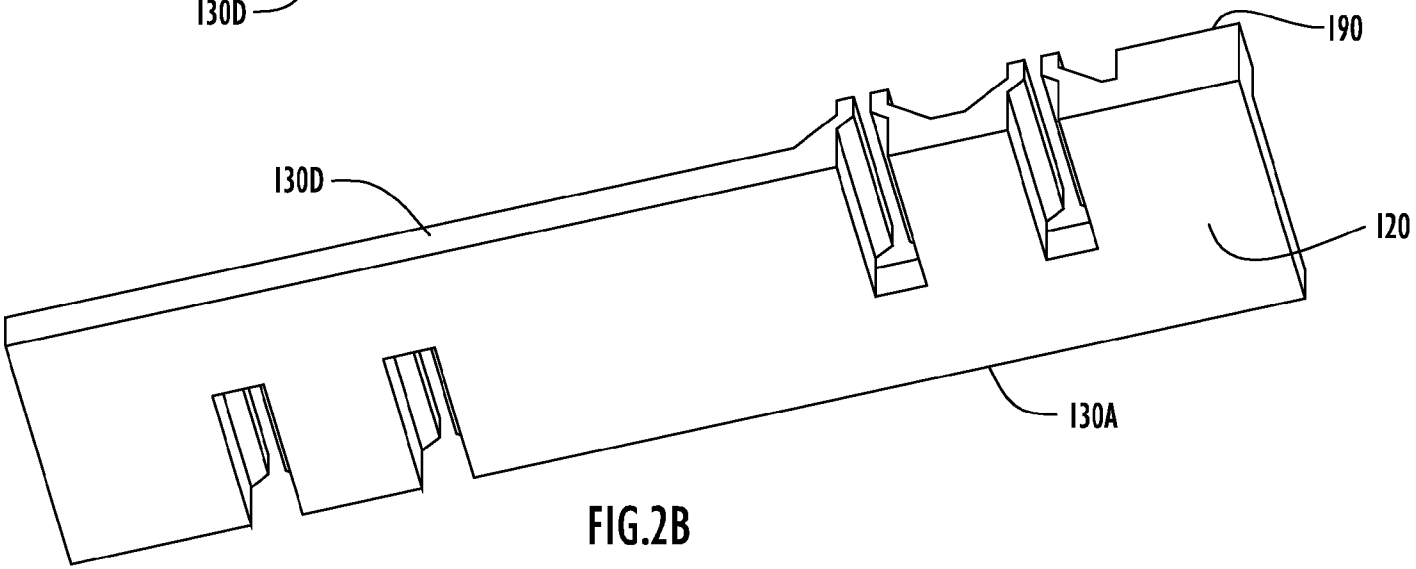
FIG. 2B illustrates a rear perspective view of the fastener clip shown in FIG. 2A.

The notches 140 may be disposed at predetermined locations along the base 105. Referring back to the embodiment of FIG. 1A, a plurality of notches 140A, 140B, 140C, 140D is spaced along the base 105 such that the open ends 160 of the notches are oriented along the top edge 130B of the base 105. Alternatively, as seen best in FIG. 2A, the notches 140A, 140B, 140C, 140D may be disposed on the base 100 such that the open end 160 of at least one notch 140A, 140B is oriented along the top edge 130B of the base 105, while the open end 160 of at least one other notch 140C, 140D is oriented along the bottom edge 130D. In either embodiment, the notches 140A, 140B, 140C, 140D extend inboard, away from the perimeter of the base 105. It is important to note that other notch configurations may be utilized without departing from the scope of the present invention.

The fastener clip 100 may further include a gripping member 190 extending from the front surface 110 of the base 105. The gripping member 190 is configured to permit the gripping and/or manipulation of the fastener clip 100 by the consumer.

Figure 5:
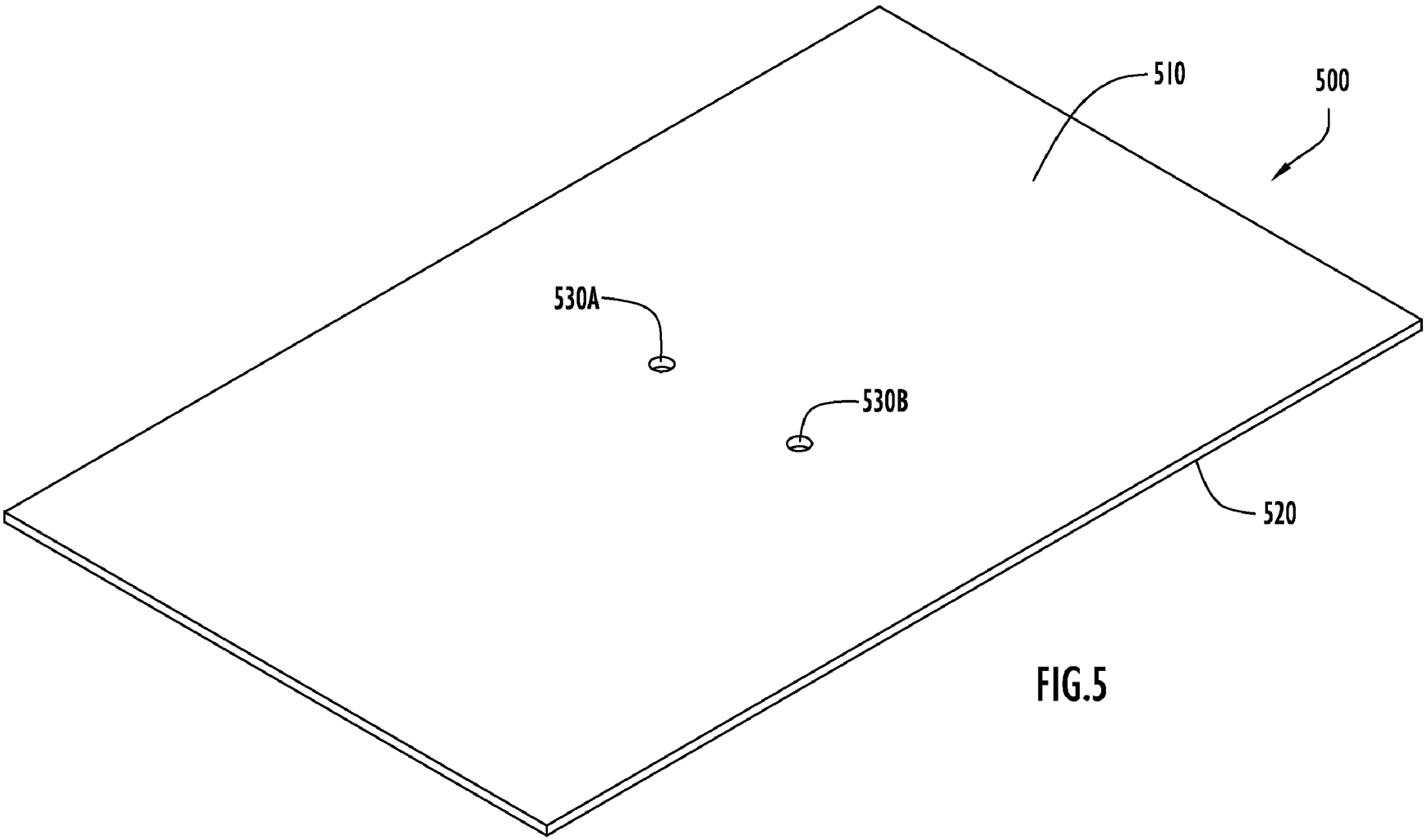
FIG. 5 illustrates a top perspective view of a product support platform in accordance with an embodiment of the invention.

The system of the present invention may be utilized with a support platform configured to support and display a product (e.g., a toy product) thereon. FIG. 5 is a top perspective view a support platform 500 in accordance with an embodiment of the invention. The support platform 500 includes a top surface 510 and a bottom surface 520. The platform 500 further includes one or more channels or through-holes (e.g., a first through-hole 530A and a second through-hole 530B) extending from the top surface 510 to the bottom surface 520. The channels 530A, 530B permit the passage of the securing member 300 therethrough. In the embodiment of FIG. 5, the support platform 500 includes a first channel 530A and a second channel 530B capable of receiving the securing member 300. The support platform 500 may be fabricated from paper board, cardboard, flake board, plastic, metal, wood, or other conventional packaging materials.

The support platform 500 may be a stand-alone unit, or may be a component housed in display or shipping packaging. For example, the support platform 500 may be housed in a display package including a rear package portion, a front package portion, a first side package portion extending between the rear package portion and the front package portion, a second side package portion extending between the rear package portion and the front package portion, and a bottom package portion. An opening may be provided within the front package portion to permit a user to access the toy at the point of sale. Alternatively, a transparent section may be provided to permit a user to view the product within the display package, while preventing a user from reaching into the display package. As with the support platform 500, the display package may be readily fabricated of conventional paper board, cardboard, flake board, plastic, metal, wood, or other conventional packaging materials. In addition, the display package may completely enclose the toy (e.g. for shipping). With this configuration, the toy product is housed within the display package.

Figure 6B:
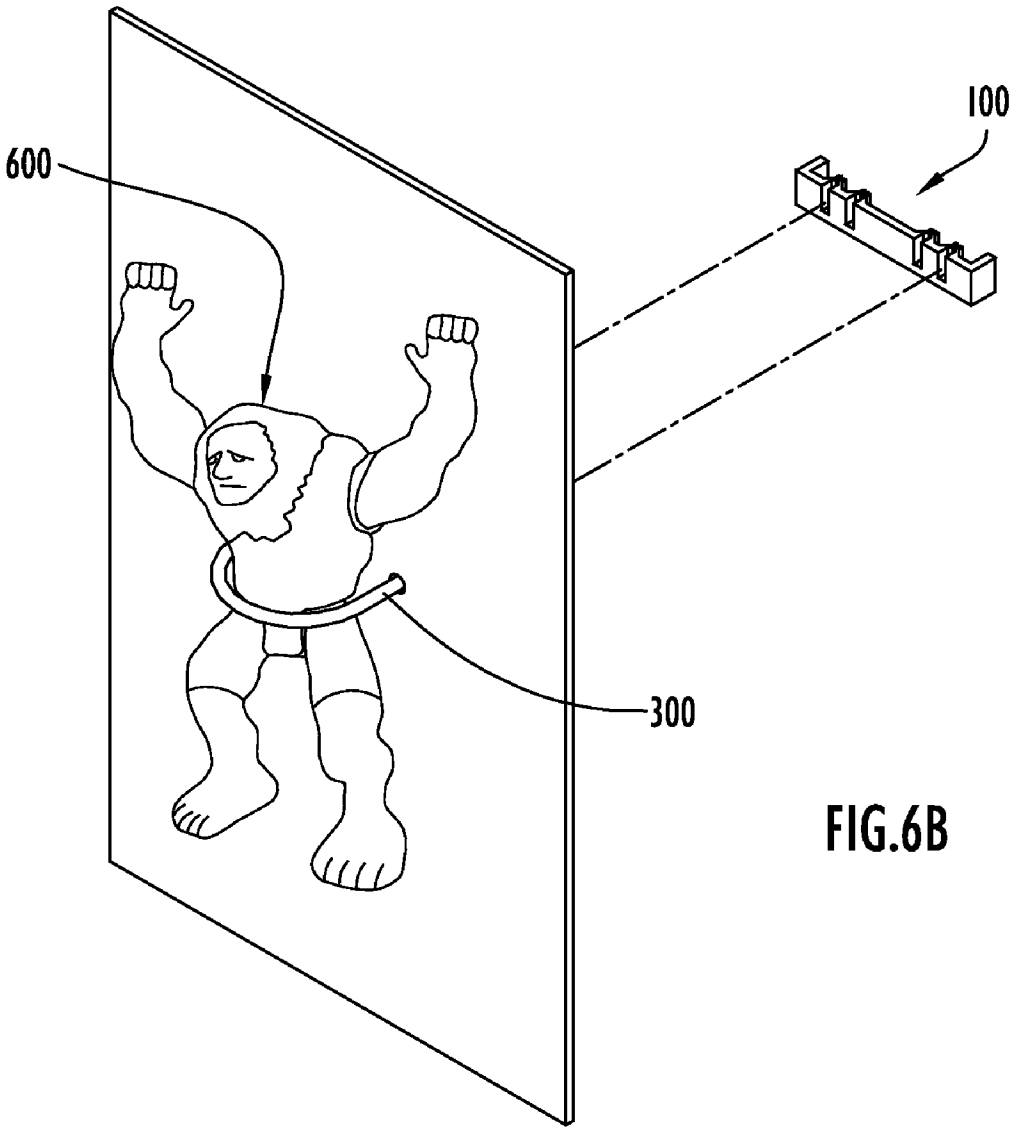
FIG. 6B illustrates a front perspective view of a toy product being secured to the support platform utilizing the pliable member.
Figure 6C:
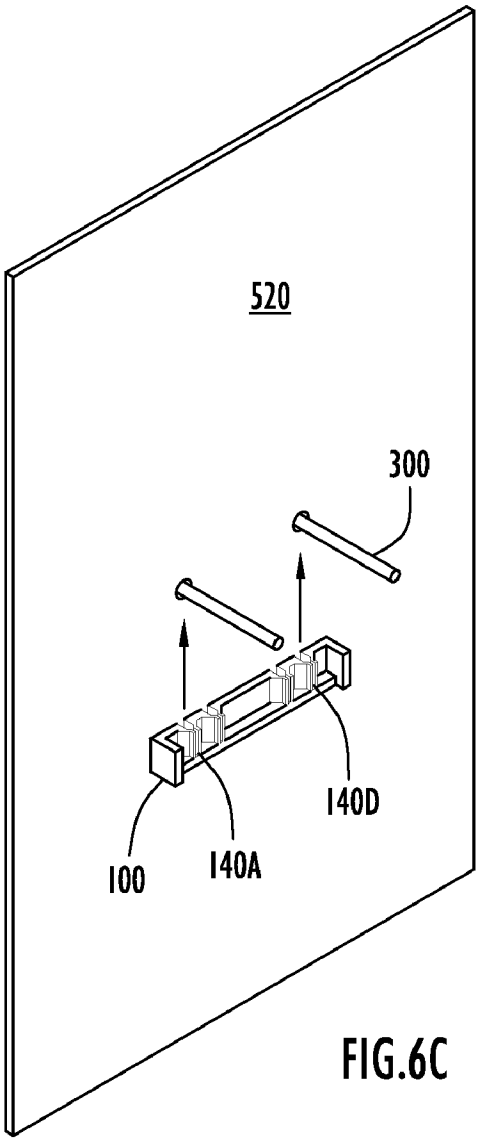
FIG. 6C illustrates rear perspective view of a toy product being secured to the support platform utilizing the pliable member.
Figure 6D:
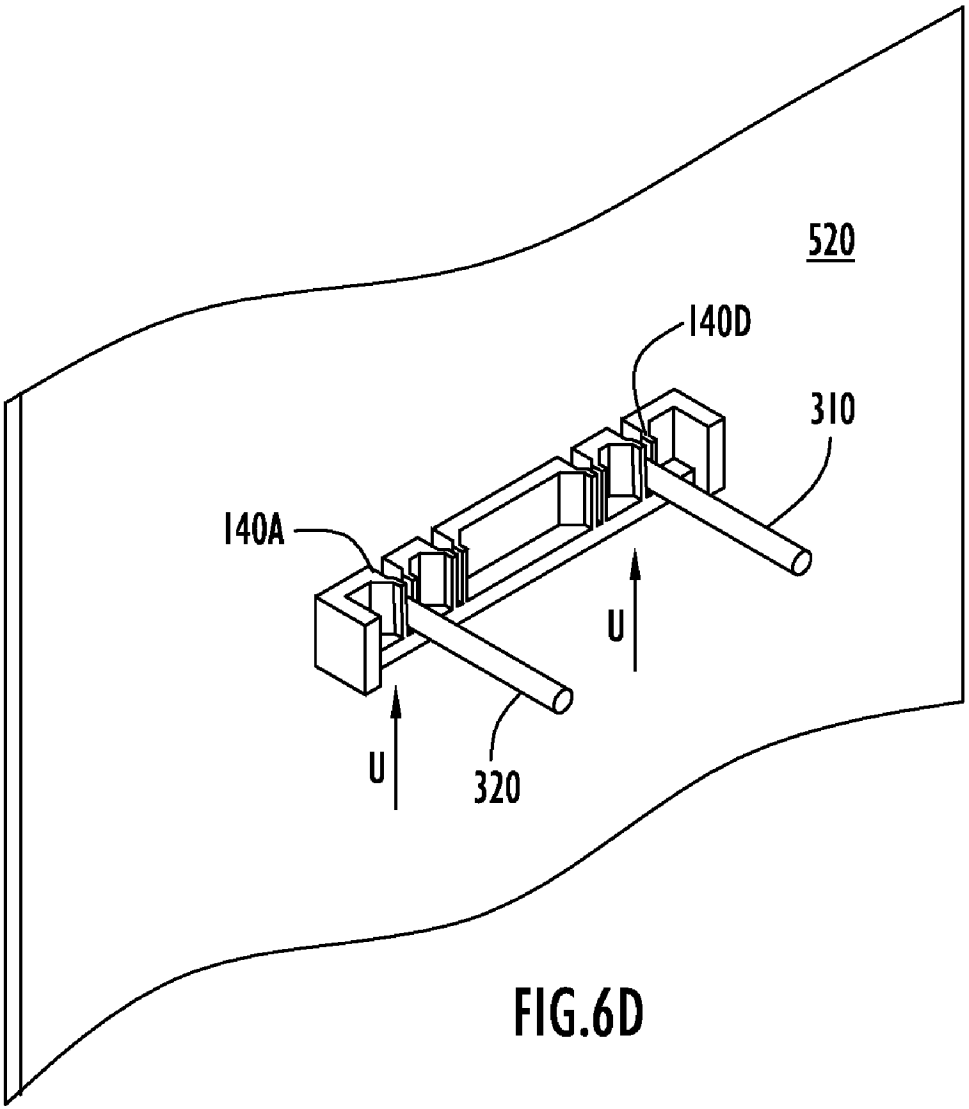
FIG. 6D illustrates connecting the clip of FIG. 1A to the pliable member.

The operation of product packaging in accordance with the present invention is explained with reference to FIGS. 6A-6D. In the exploded view of 6A, a product 600 (e.g., a toy figure) is positioned over the top surface 510 of support platform 500, while the clip 100 is positioned over the bottom surface 520. The bottom surface 120 of the clip 100 is brought into contact with the bottom surface 520 of the support platform 500. The securing member 300 is then wrapped around the product 600, with the first end 310 of the securing member 300 inserted into the first channel 530A and the second end 320 of the securing member 300 is inserted into the second channel 530B (FIG. 6B). The clip 100 is then positioned on the bottom surface 520 of the support platform 500, and brought toward the ends 310, 320 of the securing member 300 (indicated by arrow U) (FIG. 6C). The securing member 300 is then pulled generally taught around the product 600, and, as shown in FIG. 6D, the first end 310 of the securing member 300 is urged into one notch 140D, while the second end 320 of the securing member 300 is urged into another notch 140A.

The product 600 is now secured to the support platform 500, which may be secured to or housed in packaging as described above. Stated another way, when secured to the support platform 500, each notch 140A-140D permits movement of the securing member 300 along the longitudinal axis of the notch, but generally prevents movement of the securing member 300 in a direction generally transverse to the longitudinal axis of the notch. Thus, the securing member 300 may be axially urged into and removed from the notches 140A-140D, but provides a frictional force sufficient to prevent the securing member 300 from being pulled out of the notch under normal use. As a result, the product 600 remains secured to the support platform 500 during shipping and while on display, but an end user (a customer who purchased the product) can easily separate the product from the support platform 500.

Figure 7A:
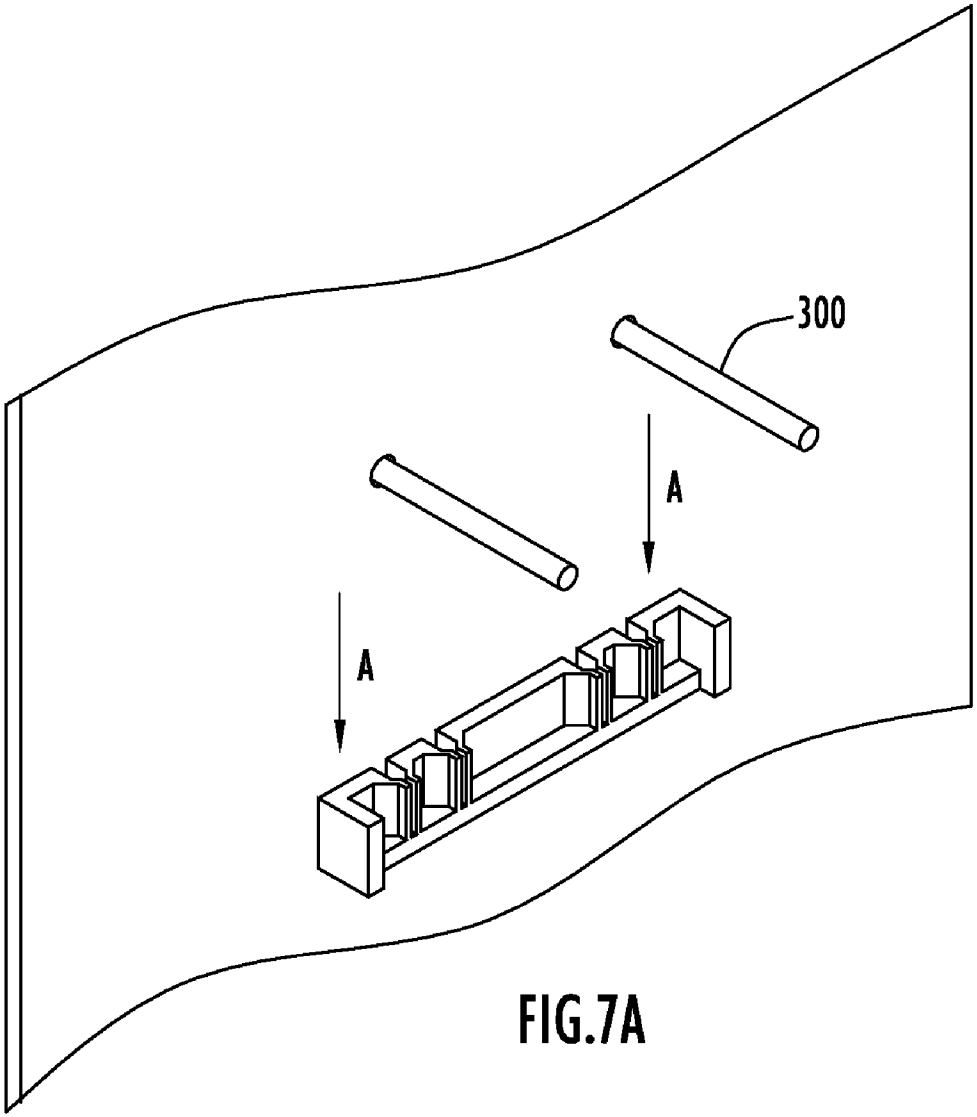
FIG. 7A illustrates separation of the clip of FIG. 1A from the pliable member.
Figure 7B:
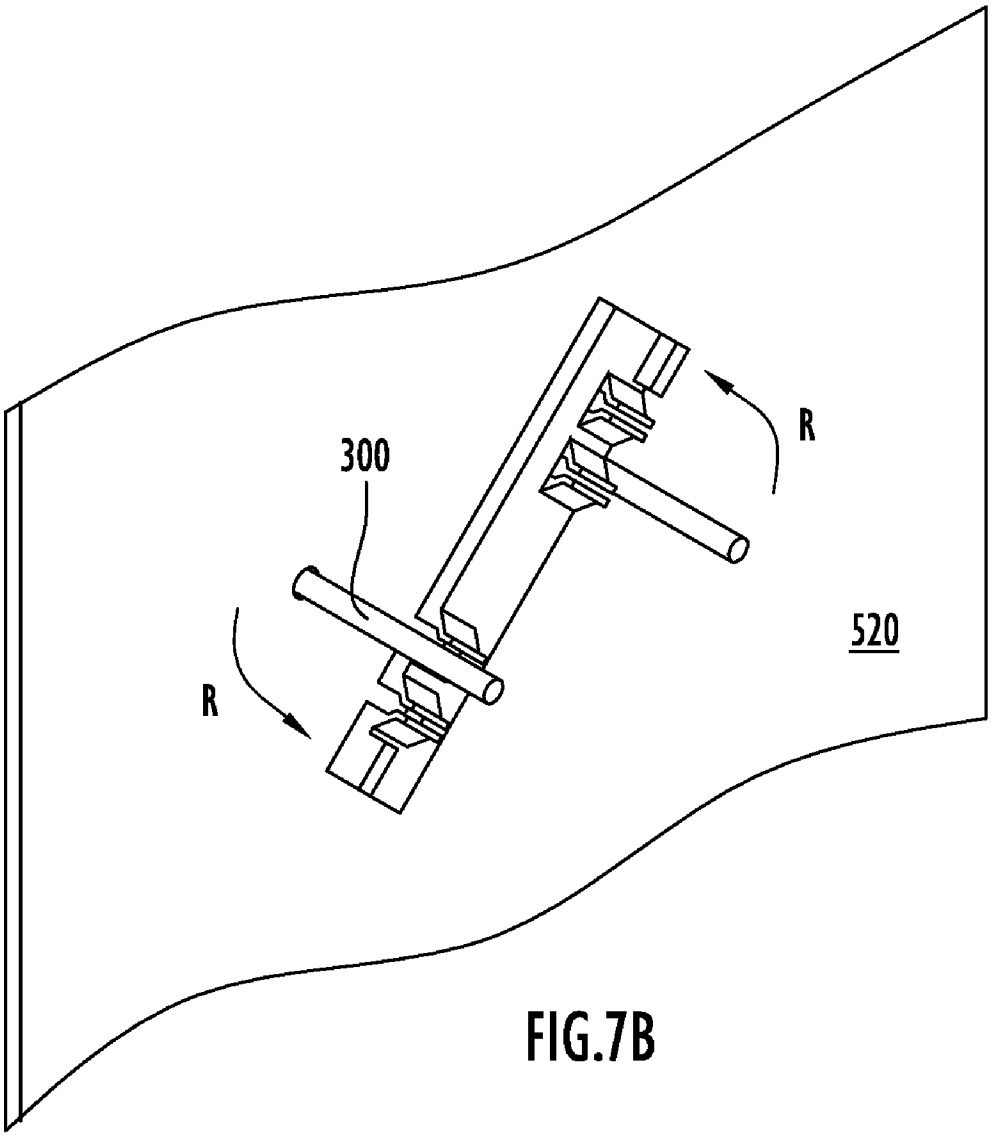
FIG. 7B illustrates separation of the clip of FIG. 2A from the pliable member Like reference numerals have been used to identify like elements throughout this disclosure.

Releasing the product 600 from the packaging is explained with reference to FIGS. 7A and 7B. In the embodiment where all of the notches 140A, 140B, 140C, 140D are oriented in the same direction (FIG. 1A/7A), a force is applied (indicated by arrow A) via the gripping member 190 to push/slide the clip 100 along the bottom surface 520 of the support platform 500, driving the clip 100 away from the securing member 300, and causing the ends 310, 320 of the securing member 300 to exit its respective notch 140A, 140D. The ends 310, 320 of the securing member 300 may then be drawn out of the channels 530A, 530B, separating the product 600 from the support platform 500. Thus, the product 600 may be separated from the support platform 500 without any unwinding or untying of the securing member 300—as would be required in conventional packaging.

Alternatively, in the embodiment where the notches 140A, 140B, 140C, 140D are oriented in opposite directions (FIG. 2A, 7B), the clip 100 is rotated away from the ends 310, 320 of the pliable member 300 (indicated by arrows R), drawing the ends out of the notches 140A, 140D. Similar to that explained above, the ends 310, 320 of the securing member 300 are then drawn out through the channels 530A, 530B, releasing the product 600 from the support platform 500. Again, the product 600 may thus be separated from the support platform 500 without any unwinding or untying of the securing member 300—as would be required in conventional packaging.

While the invention has been described in detail and with reference to specific embodiments thereof, it will be apparent to one skilled in the art that various changes and modifications can be made therein without departing from the spirit and scope thereof. For example, the clip 100 may possess any shape or dimensions, and may be formed from any suitable materials. Although a rectangular base is illustrated, the base may possess other geometric shapes including, but not limited to, squares, circles, etc. By way of further example, the clip 100 may be formed of a generally rigid material such as plastic. Similarly, the securing member 300 may be formed from any suitable materials, possess any shape, and have any suitable dimensions. The support platform 500 may be any size and shape, and be formed of any suitable material. The support platform 500 may support the entire product or only a portion of the product. Thus, it is intended that the present invention cover the modifications and variations of this invention that come within the scope of the appended claims and their equivalents. It is to be understood that terms such as "left", "right" "top", "bottom", "front", "rear", "side", "height", "length", "width", "upper", "lower", "interior", "exterior", "inner", "outer" and the like as may be used herein, merely describe points of reference and do not limit the present invention to any particular orientation or configuration.

We claim:

1. A product packaging system for a toy product, the system comprising:

a support platform for supporting the toy product, the platform including:

a first surface, a second surface, and a through-hole extending from the first surface to the second surface;

a securing member configured to pass through the through-hole formed in the toy support platform, the securing member comprising a first end and a second end;

a fastener clip configured to capture the securing member to secure the toy to the support platform, the fastener clip including:

a base having a perimeter; and at least one notch extending inward from the perimeter of the base, the notch having a longitudinal axis, wherein the at least one notch comprises converging first and second walls that frictionally engage the securing member to prevent movement of the securing member within the notch.

2. The product packaging system of claim 1, wherein the at least one notch includes a first, open end and a second, closed end.

3. The product packaging system of claim 2, wherein:

the walls taper inward along the inward direction to form a V-shaped opening;

the walls of the notch apply increasing pressure to the securing member as the securing member is drawn inward from the notch open end to the notch closed end.

4. The product packaging system of claim 1, wherein:

the base comprises a first surface and a second surface opposite the first surface;

the base is positioned such that the first surface of the base contacts the first surface of the support platform; and each notch wall comprises a ramp extending from the second surface of the base.

5. The product packaging system of claim 4, wherein:

the first notch wall comprises a proximal wall portion and a distal wall portion;

the second notch wall comprises a proximal wall portion and a distal wall portion;

the proximal wall portions converge toward each other; and the distal wall portions engage the securing member.

6. The product packaging system of claim 1, wherein the fastener clip further comprises a gripping member extending from a surface of the base, the gripping member permitting a user to grip and maneuver the fastener clip.

7. The product packaging system of claim 1, wherein:

the base is an elongated base having a top longitudinal edge, a bottom longitudinal edge opposite the top longitudinal edge, a first side edge, and a second side edge; and the at least one notch comprises:

a first notch having an open end and a closed end, wherein the open end of the first notch is oriented along the top longitudinal edge of the base; and a second notch having an open end and a closed end, wherein the open end of the second notch is oriented along the top longitudinal edge of the base in spaced relation from the first notch.

8. The product packaging of claim 1, wherein the securing member comprises a pliable strip.

9. The product packaging of claim 1, wherein:

the base comprises an elongated base having:

a first longitudinal edge and a second longitudinal edge opposite the first longitudinal edge, a first side edge and a second side edge opposite the first side edge; and the at least one notch includes:

a first notch having an open end and a closed end, the open end being oriented along the first longitudinal edge of the base, and a second notch having an open end and a closed end, the open end being oriented along the second longitudinal edge of the base.

10. The product packaging of claim 1, wherein: the securing member and the notch walls cooperate such that the fastener clip secures the toy product to the support platform without braiding the ends of the securing member together.

11. The product packaging system of claim 4, wherein the ramps extend from the base in an angularly outward direction.

12. The product packaging system of claim 9, wherein the first notch is offset from the second notch.

13. A method of fastening a product to and unfastening a product from packaging, the method comprising:

(a) obtaining a product;

(b) obtaining a product package including a support platform, wherein the support platform comprises:

a first surface, a second surface, a first through-hole extending from the first surface to the second surface, and a second through-hole extending from the first surface to the second;

(c) obtaining a pliable strip comprising a first end and a second end;

(d) obtaining a fastener clip comprising:

an elongated base having a perimeter;

a first notch and a second notch, each notch defined by a first wall and a second wall that converge to compressibly engage the pliable strip such that the pliable strip is captured by the converging walls;

(e) positioning the fastener clip on the first surface of the support platform;

(f) positioning the product on the second surface of the support platform;

(g) securing the product to the support platform by wrapping the pliable strip around at least a portion of the product, threading the first end of the pliable strip through the first through-hole, and threading the second end of the pliable strip through the second through-hole; and (h) positioning one portion of the pliable strip within the walls of the first notch and positioning another portion of the pliable member within the walls of the second notch.

14. The method of claim 13, wherein:

each notch comprises a first, open end and a second, closed end; and step (h) comprises (h.1) axially inserting each portion of the pliable strip into a respective notch via the open end.

15. The method of claim 13 further comprising (i) sliding the base of the fastener clip along the first surface of the support platform in a direction sufficient to cause the portions of the pliable strip to exit the notches.

16. The method of claim 15, wherein:

the base of the fastener clip comprises an elongated base having a first longitudinal edge, a second longitudinal edge, a first side edge, and a second side edge;

the first and second notches are oriented along the first longitudinal edge; and step (i) comprises translating the base along the first surface of the platform until the pliable strip portions disengage the notches.

17. The method of claim 15, wherein:

the base of the fastener clip comprises an elongated base having a first longitudinal edge, a second longitudinal edge, a first side edge, and a second side edge;

the first notch is oriented along the first longitudinal edge;

the second notch is oriented along the second longitudinal edge; and (i) comprises rotating the base until the pliable strip portions disengage the notches.

18. A method of removing a toy product from packaging, the method comprising:

(a) providing a product package comprising:

a platform including a first surface and a second surface, a toy positioned on the first surface, a fastening clip positioned on the second surface, the clip comprising:

a base having a perimeter, and at least one notch defined by converging walls, the notch including a first, open end and a second, closed end, and a pliable member capturing at least a portion of the toy and extending through the platform, wherein a portion of the pliable member is positioned within the at least one notch, and wherein the converging walls compressibly engage the pliable member to prevent its movement within the notch and to secure the toy to the platform; and (b) disengaging the portions of the pliable member from the at least one notch by applying a force to the base to reposition the base with respect to the second surface and draw the pliable member portions out of the at least one notch.

19. The method of claim 18, wherein:

the base comprises an elongated base having a top longitudinal edge, a bottom longitudinal edge, a first side edge and a second side edge;

the at least one notch is disposed on the base such that its open end is oriented along the top longitudinal edge; and step (b) comprises translating the base along the second surface to disengage the pliable member portions from the at least one notch.

20. The method of claim 18, wherein:

the base comprises a top longitudinal edge and a bottom longitudinal edge;

the at least one notch comprises:

a first notch disposed on the base such that its open end is oriented along the top longitudinal edge, and a second notch disposed on the base such that its open end is oriented along the bottom longitudinal edge; and step (b) comprises rotating the base along the second surface to disengage the pliable member portions from the first and second notches.

21. The method of claim 18, wherein the pliable member is separable from the fastening clip without first requiring untying of ends of the pliable member.

* * * * *